US009017760B2

(12) United States Patent
Wijpkema et al.

(10) Patent No.: US 9,017,760 B2
(45) Date of Patent: Apr. 28, 2015

(54) HYDROPHOBIC SURFACE FINISH AND METHOD OF APPLICATION

(75) Inventors: Aike Wypke Wijpkema, Eindhoven (NL); Timme Lucassen, Vught (NL); Lawrence Fabian Batenburg, Eindhoven (NL)

(73) Assignee: Nederlandse Organisatie voor toegepast-natuurwetenschappelijk onderzoek TNO, Delft (NL)

( * ) Notice: Subject to any disclaimer, the term of this patent is extended or adjusted under 35 U.S.C. 154(b) by 1025 days.

(21) Appl. No.: 12/741,829

(22) PCT Filed: Nov. 10, 2008

(86) PCT No.: PCT/NL2008/050712

§ 371 (c)(1), (2), (4) Date: Jun. 21, 2010

(87) PCT Pub. No.: WO2009/061199

PCT Pub. Date: May 14, 2009

(65) Prior Publication Data

US 2010/0267303 A1 Oct. 21, 2010

(30) Foreign Application Priority Data

Nov. 8, 2007 (EP) ..... 07120262

(51) Int. Cl.

| | |
|---|---|
| ***C23C 16/00*** | (2006.01) |
| ***B32B 5/02*** | (2006.01) |
| ***D06M 11/05*** | (2006.01) |
| ***D06M 13/513*** | (2006.01) |
| ***D06M 13/517*** | (2006.01) |
| ***D06M 13/53*** | (2006.01) |

(52) U.S. Cl.

CPC ..... *D06M 11/05* (2013.01); *D06M 13/513* (2013.01); *D06M 13/517* (2013.01); *D06M 13/53* (2013.01)

(58) Field of Classification Search

USPC ..... 427/248.1; 442/81, 85

See application file for complete search history.

(56) References Cited

U.S. PATENT DOCUMENTS 2,782,090 A * 2/1957 Robbart ..... 8/116.1

FOREIGN PATENT DOCUMENTS

| | | |
|---|---|---|
| EP | 0588242 | 3/1994 |
| GB | 1023897 | 3/1966 |
| GB | 1114782 | 5/1968 |

OTHER PUBLICATIONS

Written Opinion of the International Searching Authority, Application No. PCT/NL2008/050712, dated Feb. 4, 2009.

European Search Report, Application No. EP 07 12 0262, dated Apr. 15, 2008.

International Search Report, Application No. PCT/NL2008/050712, dated Feb. 4, 2009.

* cited by examiner

*Primary Examiner* — Lynda Salvatore

(74) *Attorney, Agent, or Firm* — Renner, Otto, Boisselle & Sklar, LLP

(57) ABSTRACT

The present invention relates to a method for hydrophobization of a fabric surface comprising providing a stream of a substantially anhydrous gas, passing said gas over or through a substantially anhydrous liquid of an alkylsilane, preferably a fluorinated alkylsilane to provide an alkylsilane, preferably a fluorinated alkylsilane vapor and bringing said vapor in contact with the fabric surface, thereby allowing the optionally fluorinated alkylsilane to bind covalently to the fabric surfaced. The present invention further relates to a fabric comprising a superhydrophobic surface finish prepared by a method of the invention and to a device for carrying out the method of the invention.

16 Claims, 4 Drawing Sheets

HYDROPHOBIC SURFACE FINISH AND METHOD OF APPLICATION

This application is a national phase of International Application No. PCT/NL2008/050712 filed Nov.10 2008.

FIELD OF THE INVENTION

The present invention relates to chemical surface modifications. In particular the present invention relates to a method for hydrophobization of a fabric surface. The present invention further relates to a fabric comprising a superhydrophobic surface finish prepared by a method of the invention and to a device for carrying out the method of the invention.

BACKGROUND OF THE INVENTION

Surface modification aims to tailor the surface characteristics of a material for a specific application without detrimentally affecting the bulk properties. At present a range of methods is used to effect surface modifications on a wide range of materials, including biomedical devices and biomaterials, wood, textiles, leather, metals, glass, ceramics, paper and plastics.

Such finishes may for instance include wettability, water-repellent and waterproofing finishes; coloration, lacquering, and abrasion protection finishes; chemical softening, easy-care, antistatic and soil-release finishes; flame-retarding finishes; and anti-microbial, rotproofing and hygiene finishes. The finish itself constitutes a chemical substance bonded to the surface by mechanical or chemical interaction.

The application of these finishes requires a specific application process and must be tailored to the material and the desirable properties. In fact, as each material differs in its surface properties the application of a finish layer thereon may require specific adaptations of the process. For instance in the field of textile finishes, such parameters as fiber nature (100% natural, synthetic or blends thereof) and inherent absorbent properties as well as weave and construction of a textile fabric, largely determine the possibility of subjecting the material to a wet finish process. In addition, the properties of the finish are very much determined by the process used. For instance when a smooth finish is to be obtained on a rough surface, a wet process that deposits large amounts of finish material is preferred.

In the field of regatta sailcloths, important improvements can be expected from surface finishes. Modern sailing regattas are high-tech events comparable to F1 car racing. Constant development of new sailcloths, weaves, yarns, laminates, foils and reinforcement fibres is extremely important for regatta yachting. The spin-off benefits of these high tech developments results in improved sailcloths for the coastal and cruising sailor.

The majority of the sails are woven cloths, often based on polyester fibres such as a polyethylene terephthalate (PET), also known as Dacron®, which provides for a durable, easy to handle and reasonably priced product. Over the years these relatively traditional weaves have been improved with respect stretch and UV resistance, durability, and ease of handling and maintenance resulting in the production of sails based on ultra high molecular weight polyethylene (UHMWPE, e.g. Spectra® and Dyneema®), liquid crystal polymer (LCP, e.g. Vectran®), polyethylene naphthalate (PEN, e.g. Pentex®), or aramid (e.g. Kevlar® and Twaron®) fibers.

In search for lighter materials, laminate sailcloths have been developed that consist of 3-5 alternating layers of a woven material, for instance in the form of a taffeta (silk weave), scrim (loose mesh) or inlay (strands) as the primary load carrier and for abrasion resistance, and a film material such as PET (e.g. Mylar®) or PEN for holding the fibres in place and providing stretch resistance. These layers are glued together to provide the laminate. Laminate sailcloths are stronger and more stretch resistant and therefore particularly useful for larger sail areas common for the larger yachts. Their low weight also makes these sails easier to handle and improves sailing efficiency, however, at the expense of increased costs and reduced durability, since these laminates are prone to de-lamination and mildew. In addition, improved water-repellency is required.

Water introduced between the sheets or the seams of the sailcloth is a serious cause of fungal growth. An increase in the water-repellency of the sailcloth reduces the infiltration of water in the sailcloth. In addition, because weight is very important for sailcloths, water-repellency prevents accumulation of water and dirt (anti-staining), and provides for stable lightweight characteristics.

It is well known that the hydrophobicity of a surface determines its water-repellency. One existing method for providing hydrophobicity uses a wet finish process which involves the application of a liquid coating solution to the material surface and an intensive post-application treatment to activate the hydrophobic properties of the coating. These wet coatings are not very durable as they are insufficiently permanent. Also, large amounts of coating solution are required making the process costly. Most importantly these methods result in a significant increase in the weight of the material.

An example of such a wet finishing process is described in GB114782. GB114782 describes the use of fluorine-silicon adducts and the impregnation of a textile fabric by spraying or dipping with a solution of the fluorine-silicon. This is an example of a wet finish process that does not result in a monomolecular layer. The disadvantage of that method is that the fabric becomes too heavy.

Another example of such a wet finishing process is described in EP0588242. EP0588242 describes the covalent binding of chlorosilane based chemical adsorbents to a material surface wherein a in the form of monomolecular film bonded to materials via a chlorosilane layer in order to render these material water and oil repellent. The process of EP0588242 comprises contacting the material with a chlorosilane solution to adsorb the chlorosilane to the material, removing the unbound chlorosilane and reacting the unreacted chlorosilyl groups of said adsorbed chlorosilane with water to form a chemically adsorbed monomolecular film. Subsequently, a chlorosilane-based chemical adsorbent having fluorocarbon groups is chemically adsorbed to this film, thus forming a chemically adsorbed monomolecular film having water- and oil-repelling properties. This method comprises several steps and is not a one-step process. Furthermore, the alkylsilane is not bonded directly to the surface of the fabric.

Another existing method uses a gas phase process involving the deposition of gaseous precursors under the influence of a plasma.

Gas plasma treatment has the advantage that very thin layers can be deposited. However, the problem with such methods is that they are very expensive as dedicated equipment is needed for applying the coating. In addition, these methods are very difficult to perform on the scale needed for treating the large surface areas of sails as the processes must be carried out at reduced pressure in a treatment chamber housing the plasma source.

Thus, the problem with current methods for hydrophobing a material surface, and in particular a material having a large surface area such as a sailcloth, is that these methods result in a significant increase in weight and that the coating is insufficiently durable, or that they are not economical.

The aim therefore is to provide an economic method by which a hydrophobic functionality can be added to the cloth without significantly increasing its weight, and without compromising durability and wear resistance.

GB1023897 discloses the use of a two-step method for rendering fibrous material water-repellent comprising a first step of using an organic ester of titanium or an alkyl tin carboxylate as a catalyst followed by a second step involving the treatment with a vaporous fluorohydrocarbon alkoxysilane having an alkoxygroup as hydrolysable group. The drawback of this process is that it is very uneconomical to perform two separate treatment steps on a large areas of material such as a sailcloth.

SUMMARY OF THE INVENTION

The present inventors have found a method of providing a finishing to mostly any material surface but particularly to fabrics, by treating that surface with a reactive vapor and allowing the deposition of the coating molecules on the material surface from the vapor phase in a single step. A fabric of the invention comprises an alkylsilane bonded directly to the fabric surface by chemisorption without an intermediate layer.

In a first aspect, the present invention relates to a method for hydrophobization of a fabric surface comprising providing a stream of an essentially anhydrous gas, passing said gas over or through an essentially anhydrous liquid of an alkylsilane, preferably a fluorinated alkylsilane, to provide an alkylsilane vapor, preferably a fluorinated alkylsilane vapor, and bringing said vapor in contact with the fabric surface, thereby allowing the (fluorinated) alkylsilane to bind covalently to the fabric surface.

Essentially, the fabric surface requires no pretreatment. Therefore, treatments with catalyst, etching agents, corona treatments of other methods of providing a chemically functionalized surface are not required, meaning that the surface needs not be provided with reactive chemical moieties or groups that can form covalent or ionic bonds with the alkylsilane in a separate pretreatment step.

The present invention also provides a fabric comprising a superhydrophobic surface finish prepared by a method of the invention as described above. In aspects of the invention, the fabric is preferably a sailcloth material, most preferably a sailcloth material is based UHMWPE, LCP, PEN, PET, carbon, glass fiber, polyamid or aramid or combinations thereof.

The method of the invention is very advantageous as it allows the provision of the superhydrophobic surface to porous materials.

The fabric comprising the superhydrophobic surface finish of the invention preferably is in one embodiment preferably a porous fabric. The porous fabric of the invention may have a porosity expressed as the ratio of free (void) volume relative to total fabric volume of more than 0.1, preferably between 0.2 and 0.99, more preferably in a range from 0.3, 0.4, 0.5, 0.6, 0.7, 0.8, or 0.9 to about 0.4, 0.5, 0.6, 0.7, 0.8, 0.9 or 0.95. A ratio of 0.9 refers to a porosity of 90%. The porosity may be determined on the basis of the density ρ of the porous fabric and the density of the bulk fabric material $\rho_0$ as:

$$\text{porosity} = \frac{\rho_0 - \rho}{\rho_0} \times 100\%$$

The porous fabric preferably has a porosity of at least 50%.

In another aspect, the present invention provides a device for hydrophobization of a fabric surface comprising a reservoir for holding a substantially anhydrous liquid of an alkylsilane, preferably a fluorinated alkylsilane, said reservoir comprising an inlet for receiving a flow of a substantially anhydrous gas, wherein said reservoir is adapted to allow passage of said substantially anhydrous gas over or through said substantially anhydrous liquid to provide an alkylsilane vapor, preferably a fluorinated alkylsilane vapor, said reservoir further comprising a conduit for passing said optionally fluorinated alkylsilane vapor to a coating chamber, and wherein said coating chamber is adapted for holding a fabric and exposing the surface of said fabric to the optionally fluorinated alkylsilane vapor.

LEGENDS TO THE FIGURES

Figure 1:
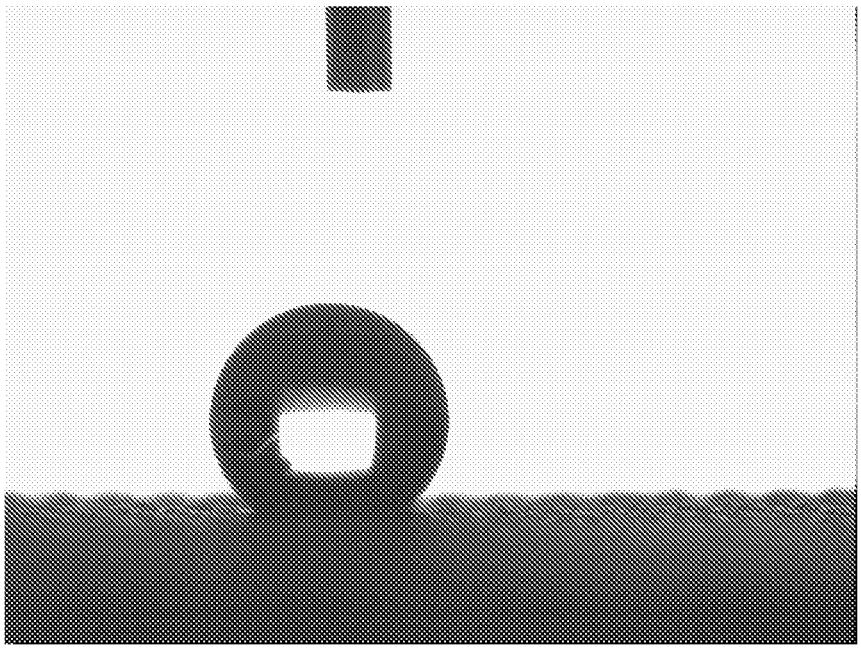
FIG. 1 shows a water droplet on polyester sailcloth treated with gas phase fluorinated alkylsilane as described in the Examples.
Figure 2:
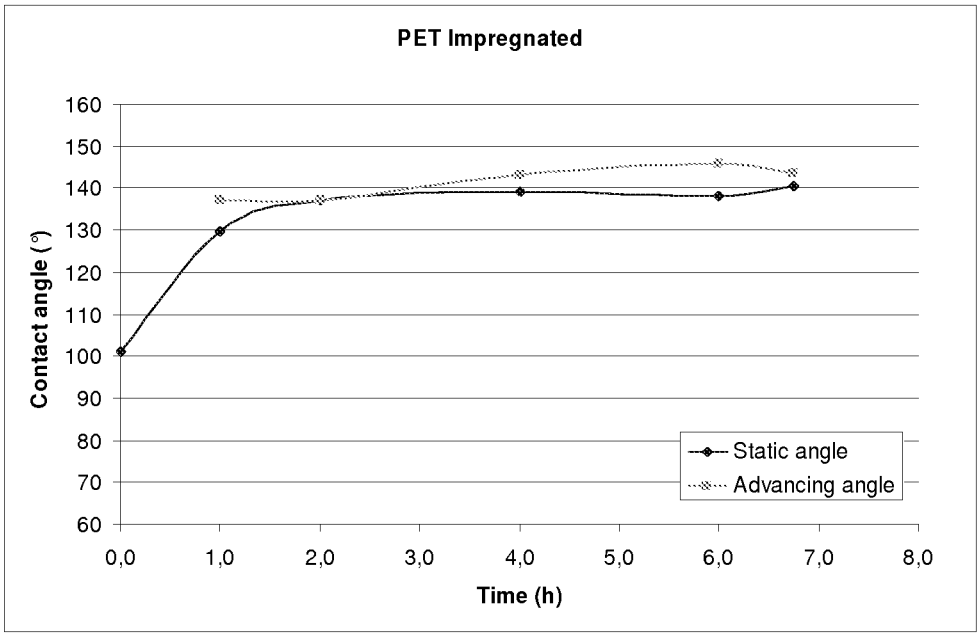
FIG. 2 shows in a graphical display the static and advancing contact angles over time of impregnated polyester sailcloth treated with the optionally fluorinated alkylsilane as described in the Examples.
Figure 3:
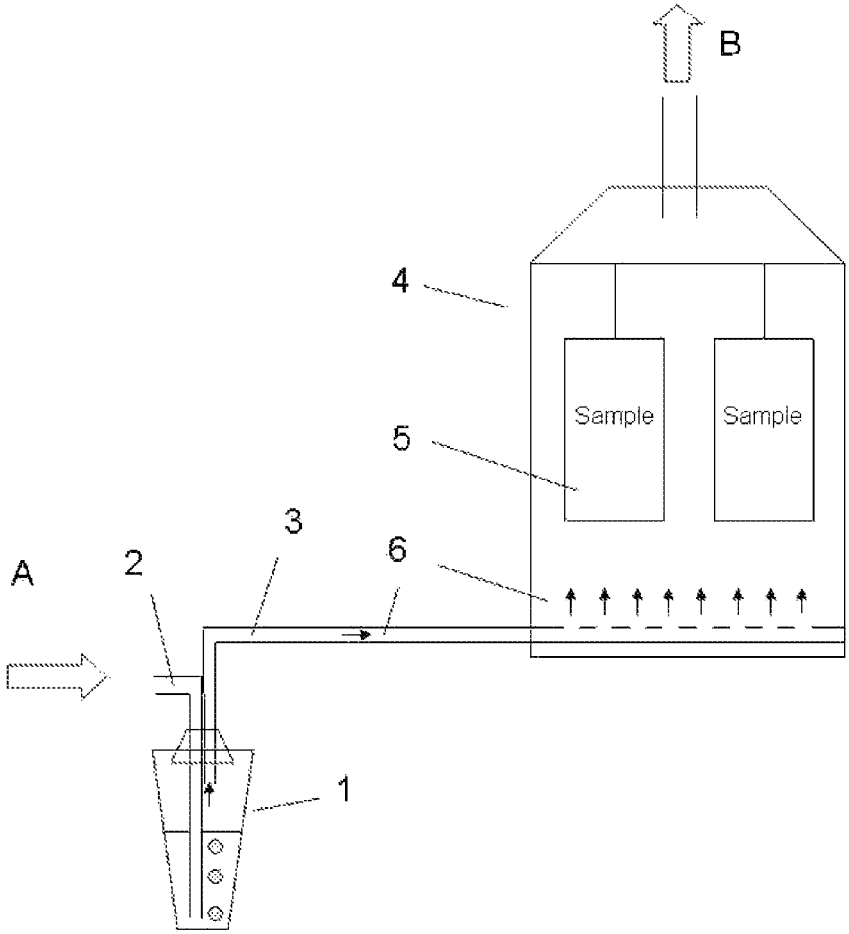
Figure 4:
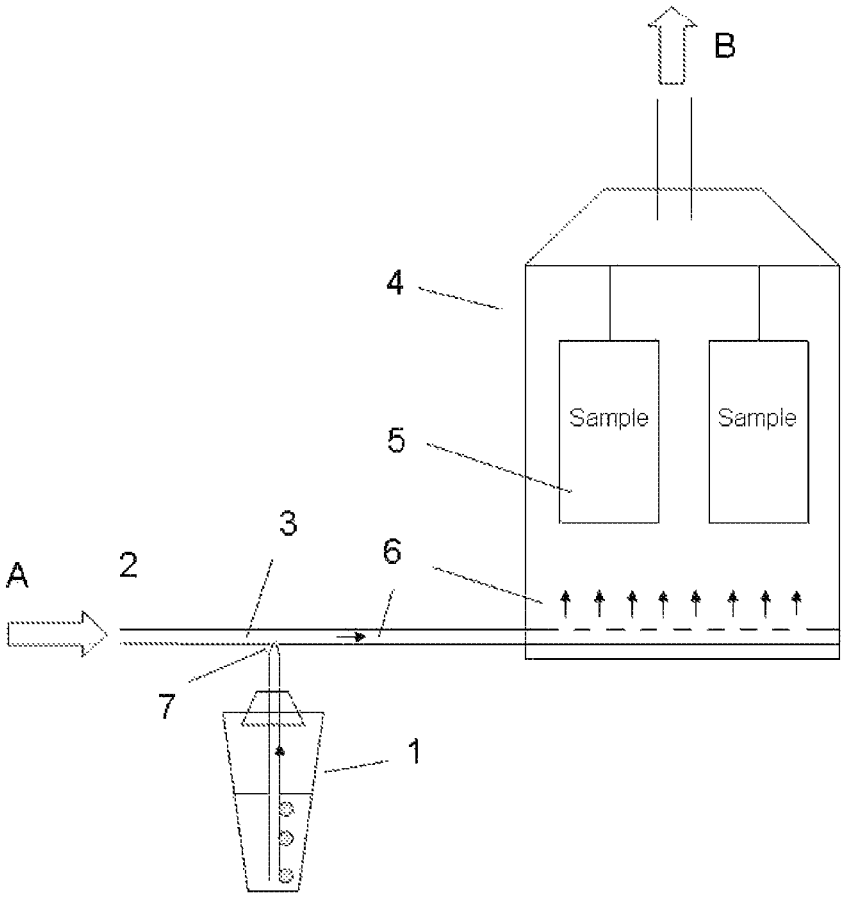

FIGS. 3 and 4 show schematic setups of devices for performing the method of the present invention and exemplifies the various features of the device: reservoir (1), carrier gas inlet (2), conduit (3), coating chamber or reactor (4), fabric sample (5) fluorinated alkylsilane vapor (6) and spraying nozzle (7). "A" indicates input or source of carrier gas, "B" indicates output of carrier gas plus unreacted alkylsilane. For detailed description, see below.

DESCRIPTION OF THE PREFERRED EMBODIMENTS

In the present description, the term "alkyl" refers to a monovalent group derived from an alkane through the removal of a hydrogen atom from one of the carbon atoms and comprises a straight chain or branched chain having from 1 to 30, preferably from 2 to 20 carbon atoms. The term "alkyl group" refers to an alkyl radical. Examples of such radicals are methyl, ethyl, n-propyl, isopropyl, n-butyl, isobutyl, sec-butyl, tert-butyl, pentyl, iso-amyl, hexyl, octyl, decyl, and dodecyl.

The term "silane" refers to a compound with the chemical formula $SiH_4$, which refers to the monomer. Silane polymers are included in the term "silane".

The term "alkylsilane" refers broadly to a monomer or polymer comprising the chemical formula $R_pSiH_{4-p}$, wherein R is alkyl group and p is an integer from 1 to 3, preferably 1. The alkylsilane in aspects of the present invention is (and includes reference to) a reactive alkylsilane with the chemical formula $R_pSiX_rH_{4-p-r}$, wherein R is alkyl group, X is a hydrolysable group, p and r are independently selected from integers 1 to 3, p preferably being 1, r preferably being 3. The hydrolyzable groups are independently selected. Suitable hydrolysable groups include (a) organic groups linked to the silicon atom by an oxygen bond, preferably an alkoxy group, and (b) halogens. Examples of such organic groups include acetoxy, phenoxy, epoxy, alkoxy, and alkenyloxy. More preferably, the hydrolysable group X is reactive with hydroxyl groups of the fabric surface. More preferred hydrolysable groups are therefore selected from alkoxy and halogens. Alkoxy includes but is not limited to methoxy, ethoxy, propoxy, butoxy, and pentoxy groups. Preferred halogens are fluorine, chlorine, bromine and iodine, most preferably chlorine. Chemisorption of reactive alkylsilanes, occurs via cleavage of at least one of the Si—X bonds and subsequent formation of at least one covalent Si-fabric surface bond.

Most preferably the hydrolysable group is a halogen, most preferably F or Cl.

The term "chemisorption" refers to the chemical adsorption arising from a chemical bond formation between an adsorbent, e.g., the fabric surface, and adsorbate, e.g., the alkylsilane, which takes place in a monolayer on the surface of the adsorbent.

The alkylsilane in aspects of the present invention is (and includes reference to) an a fluorinated alkylsilane. The term "fluorinated" refers to the substitution of hydrogen groups for fluor groups in the alkyl chain of the alkylsilane.

The method of the present invention involves contact between a fabric surface and a reactive fluorinated alkylsilane vapor. It is important to note that the method is performed without any direct contact between the solution of the alkylsilane (the optionally fluorinated alkylsilane liquid) and the fabric surface, yet the surface is essentially completely provided with the required finish. It is an advantage of the present invention that the fabric surface does not require any specific pre-treatment. The process may very suitably be carried out at room temperature and under atmospheric pressure, and although the process may be plasma enhanced, the deposition process is typically carried out in the absence of a plasma. This means that a very simple process environment may be used. Another advantage of the present method is that no curing of the finish is required.

The material finish preferably consists of a monomolecular layer of at least one optionally fluorinated alkylsilane. The monomolecular layer may comprise a single optionally fluorinated alkylsilane or a mixture of optionally fluorinated alkylsilanes. The monolayer may take the form of a crosslinked network of optionally fluorinated alkylsilanes or of a polymer brush of tethered optionally fluorinated alkyl chains attached to the surface via the silane moiety.

As used herein the term "alkoxysilane" refers to a compound comprising one, two, three, or four alkoxy groups bonded to a silicon atom. For example, tetraalkoxysilane refers to Si(OR)4, wherein R is alkyl. Each alkyl group can be the same or different. An "alkylsilane" refers to an alkoxysilane wherein one or more of the alkoxy groups has been replaced with an alkyl group. Thus, an alkylsilane comprises at least one alkyl-Si bond. The term "fluorinated silane" refers to an alkylsilane wherein one of the alkyl groups is substituted with one or more fluorine atoms.

The optionally fluorinated alkylsilanes useful in the present invention will generally have an alkyl chain of 2-20 carbon atoms, preferably 8-12 carbon atoms, which alkyl chain may be branched. The distal carbon atoms of the alkyl chain (the ones at the extreme end of the chain as seen from the silane) are preferably entirely substituted by fluorine.

The optionally fluorinated alkylsilane is preferably a perfluoroalkylsilane with the general formula:

$$CF_3—(CF_2)_n—(CH_2)_m—SiX_3$$

wherein, n is an integer from 0 to 12 m is an integer from 2 to 5

X is a hydrolyzable group as defined above.

Preferably, the perfluoroalkylsilane is selected from the group consisting of $CF_3—(CF_2)_5—(CH_2)_2—SiCl_3$ (1H, 1H, 2H, 2H-perfluorooctyltrichlorosilane), $CF_3—(CF_2)_7—(CH_2)_2—SiCl_3$ (1H,1H,2H,2H-perfluorodecyltrichlorosilane), and $CF_2—(CF_2)_9—(CH_2)_2—SiCl_3$ (1H, 1H, 2H, 2H-perfluorododecyltrichlorosilane).

The monomolecular layer of the present invention is not adsorbed to the fabric surface via a chlorosilane monomolecular film or polysiloxane chemically adsorbed film, but are adsorbed directly to available reactive groups on the fabric surface.

The optionally fluorinated alkylsilane in aspects of the present invention is used in the form of a vapor and in the form of a liquid, from which the vapor is created. The liquid is preferably essentially pure optionally fluorinated alkylsilane, whereby purities of about 95%-99% are very suitable, and are commercially available.

The optionally fluorinated alkylsilane preferably has a high boiling point. Suitably, the boiling point of the optionally fluorinated alkylsilane is in the range of 60-300° C., more preferably 190-260° C.

In aspects of the present invention the substantially anhydrous gas is preferably nitrogen, argon or dry air. Such gases may be obtained from any commercial source. The substantially anhydrous gas is used as a carrier gas to generate a vapor from the optionally fluorinated alkylsilane liquid, when the gas is passed through or over said liquid. Generally an optionally fluorinated alkylsilane in carrier-gas vapor comprising 1 wt % to 99 wt % of optionally fluorinated alkylsilane may be generated from the liquid by passage of the carrier gas. Vapor density may be regulated by controlling the flow rate of the carrier gas. The skilled person will understand that higher vapor densities will result in faster build-up of the finish on the fabric in the reactor, while higher flow rates will result in faster equilibrium (more controlled finishing process) in the reaction chamber. In addition, finish thickness can be controlled by vapor density in the reactor and residence time of the fabric in the reactor atmosphere. The skilled person is therefore well able to select and optimize the process conditions.

A method of the present invention, wherein the surface finish is applied to a sailcloth, may essentially be performed as follows.

In order to produce a vapor of reactive fluorinated alkylsilane, any method may be used. Devices generally used as humidifiers or evaporators or any other device for forcing liquid molecules into the gas phase may be adapted or used directly to provide vapors of reactive fluorinated alkylsilane. Suitable devices may for instance comprise a reservoir, wick and fan, wherein the reservoir holds the optionally fluorinated alkylsilane liquid, the wick absorbs liquid from the reservoir, and the fan, being adjacent to the wick, blows a carrier gas onto the wick, thus aiding in the evaporation of the liquid within the wick.

In a preferred embodiment one may use a conventional gas-washing bottle or gas bubbler, fill the bottle at least partially with the optionally fluorinated alkylsilane liquid and bubble gas through said liquid to obtain an alkylsilane, preferably an optionally fluorinated alkylsilane vapor in the headspace of the bottle, which can then be passed over the fabric. In such instances, the carrier gas is suitably nitrogen gas.

The optionally fluorinated alkylsilane vapor is then brought into contact with the fabric by any suitable method. Because the vapors are harmful at least, it is preferred that the vapors are passed over the fabric in a reactor, which should be a sufficient size to maintain the surface exposed to the vapor. The reactor is thereto provided with a vapor inlet to lead the vapor into the reactor. The reactor may suitably be equipped with an outlet to purge the atmosphere of the reactor with the vapor. In the reactor, a vapor flow may be maintained throughout the finishing process, or, alternatively, a constant and static vapor may be used in the reactor. Suitable vapor densities are 1-90 wt %, preferably a vapor density equivalent to an $3\text{-}4*10^{-4}$ kilogram chemical per $m^3$ gas may be indicated. During the finishing process, the cloth is preferably essentially completely unfolded or arranged such that the vapor has free access to the entire surface of the cloth. The optionally fluorinated alkylsilane may be allowed to deposit from the vapor onto the cloth during an period of several hours to several days. Preferably, the procedure is carried out overnight (about 14 hours). The deposit entails the covalently bonding of the optionally fluorinated alkylsilane to the sailcloth.

The entire process may be carried out at room temperature and atmospheric pressure, although evaporation of the optionally fluorinated alkylsilane may be facilitated by increased temperatures.

In embodiments of the present invention it is possible, and in fact preferred, that spraying of the optionally fluorinated alkylsilane into the gas stream is very effective in creating the silane vapor. Thus in preferred embodiments of methods of the invention, the optionally fluorinated alkylsilane is injected as a nebula (or spray) into the gas stream, whereafter the nebula dissolves in the gas stream to form the vapor which is then brought into contact with the fabric to be treated. In a preferred embodiment the optionally fluorinated alkylsilane is injected as a spray in a heated gas stream. The hot gas stream and/or the optionally fluorinated alkylsilane spray may have a temperature of between 20-200° C. when mixed. More preferably between 50-150° C., still more preferably between 75-90° C.

Alternatively, the optionally fluorinated alkylsilane may be heated and sprayed into a cooler gas stream, or the optionally fluorinated alkylsilane may be heated and then injected into a heated carrier gas stream. The temperature difference between the optionally fluorinated alkylsilane and the gas stream is preferably small enough to avoid condensation of the optionally fluorinated alkylsilane. Most preferably, the optionally fluorinated alkylsilane is injected into a gas stream of carrier gas that is heated to optimize vaporization of the optionally fluorinated alkylsilane which facilitates mixing with the heated gas stream.

As stated above, the present invention also provides a fabric comprising a superhydrophobic surface finish prepared by a method of the invention as described above.

The fabric as used in aspects of the present invention may be any fiber-based material. Examples of suitable fibers include, but are not limited to fibers of cellulose, protein, hemp, flax, cotton, jute, wool, sisal, UHMWPE, LCP, PEN, PET, carbon, glass fiber, polyamid or aramid fibers, or combinations thereof. The fabric may be a non-woven, but is preferably a woven fabric. In particular, the fabric is a sailcloth material. The term sailcloth means any a strong fabric used for making sails and tents, and includes reference to any layer of a laminated sailcloth. The sailcloth materials may be based on any suitable material, preferably polyester or nylon. Preferred sailcloth fabrics are based on yarns of UHMWPE, LCP, PEN, PET, carbon, glass fiber, polyamid or aramid fibers or combinations thereof. The woven may be a taffeta, a scrim or an inlay. The sailcloth laminate layer may essentially be of the same material as the fibers, but is usually extruded. Very suitable sailcloth laminate layer materials are PET and PEN.

Depending on the reactants used, the finish will be deposited on the fabric in the form of a monolayer. The thickness of the hydrophobic layer is between 10 and 20, preferably about 15 Å. By appropriately selecting the reaction conditions, two-dimensional monomolecular layers may be obtained, having increased thickness (e.g. between 10 and 500, preferably between 50-200, most preferably around 100 Å). The general structure of these layers is, for each fluorinated alkylsilane, a covalent bond with the material surface and two covalent bonds with adjacent fluorinated alkylsilane molecules. The layer so formed is a monolayer with polysiloxane units in which the optionally fluorinated alkylsiloxanes are regularly grafted as tethered chains.

The monomolecular layer presents, towards the outside, chains of the optionally fluoronated alkylsilane, such as fluorocarbonated chains, in a regular arrangement, with the extremity of the chains constituting the external side of the finish. According to a preferred embodiment of the invention, at least the extremities of the alkyl chains are fluorinated, which not only imparts to them a particularly pronounced hydrophobic character, but also a high resistance to aging when the coated material is exposed to UV radiation.

According to the invention, a coating is obtained that provides a superhydrophibic surface coating of ultra low weight and high durability in terms of mechanical and chemical resistance. The contact angle of a drop of water with the coating of the invention is more than 100° and, advantageously, more than 115°. In particular when applied to a polyester weave such as a PET sailcloth, the contact angle will be more than 132°, advantageously, more than 135°, still more advantageously, more than 138°, 139° or 140°. In particular when applied to a nylon weave such as a spinnaker of woven polyamide-6,6 yarns, the contact angle will be more than 123°, advantageously, more than 125°, still more advantageously, more than 130°, still more advantageously, more than 131, 132, 133, 134, 135, 136 137 and 138°. The contact angle may suitably be determined by using a Kriiss DSA 100 prop shape analyzer.

The sailcloth of the invention is preferably of a porous material. Preferably having a porosity of 0.8-0.9.

In another aspect, the present invention provides a device specifically adapted for carrying out the method of the invention. In this aspect, the invention relates to a device for hydrophobization of a fabric surface comprising a reservoir (1) for holding a substantially anhydrous liquid of an alkylsilane, preferably a fluorinated alkylsilane, said reservoir comprising an inlet (2) for receiving a flow of a substantially anhydrous gas, wherein said reservoir is adapted to allow passage of said substantially anhydrous gas over or through said substantially anhydrous liquid to provide an alkylsilane vapor, preferably a fluorinated alkylsilane vapor; said reservoir further comprising a conduit (3) for passing said optionally fluorinated alkylsilane vapor to a coating chamber (4); and wherein said coating chamber is adapted for holding a fabric (5) and exposing the surface of said fabric to the optionally fluorinated alkylsilane vapor (6). An example of a suitable device is provided in FIG. 3.

Alternatively, a device for hydrophobization of a fabric surface comprises a reservoir (1) for holding a substantially anhydrous liquid of an alkylsilane, preferably a fluorinated alkylsilane, said reservoir being arranged for nebulating said optionally fluorinated alkylsilane, for instance by having a spraying nozzle at an outlet (7) of said reservoir through which optionally fluorinated alkylsilane is expelled from said reservoir, such as for instance by air pressure or other pressure, resulting in a spray of the optionally fluorinated alkylsilane leaving the outlet (7) wherein said outlet is engaged with a conduit (3) which is arranged for transporting a flow of a substantially anhydrous gas from a suitable gas source (A) to a coating chamber (4) such that the spray of the optionally fluorinated alkylsilane leaving the outlet (7) is mixed with said carrier gas in said conduit (3) at a position between said source (A) and said chamber (4) to provide a fluorinated alkylsilane vapor; and wherein said coating chamber (4) is adapted for holding a fabric (5) and exposing the surface of said fabric to the optionally fluorinated alkylsilane vapor (6). An example of a suitable device is provided in FIG. 4.

Optionally, a device of the invention may comprise heating means, such as heating coils, microwave antenna, infrared source for heating the carrier gas, the optionally fluorinated alkylsilane in the reservoir, the conduit at or before the point in the flow where the optionally fluorinated alkylsilane spray enters the conduit, or the chamber.

The device may further optionally be fitted with a vapor flowmeter, which may be positioned at the inlet, or the conduit, to monitor the flow of vapor through the system. In addition, the device may be fitted with an instrument for measuring vapor density. Such instruments are well known in the art.

The device is loaded with carrier gas, fluorinated alkylsilane and fabric samples to be treated. The output of the device consists of unreacted alkylsilane and finished fabric. The unreacted alkylsilane may optionally be fed back into the system.

The device can be designed for discontinuous and for continuous operation. For continuous operation the fabric is fed continuously to the device, resides in the device for a period of 0.1-3600 seconds, preferably 1-60 seconds, and finally leaves the device as a finished fabric. For discontinuous operation the fabric is put in the device discontinuously, resides in the device for a period of 30-72000 seconds, preferable 60-3600 seconds, and is removed from the device after this period of time. For continuous operation, the device is preferably provided with suitable transport means, such as a through calenders (rollers) and stenters (fabric stretchers).

The methods of the present invention may be carried out by sail makers, or by specialized coating businesses. Such businesses are preferably equipped for handling the harmful and corrosive fumes of the optionally fluorinated alkylsilanes generated during performance of the method of the invention. The present invention will now be exemplified in the following examples.

EXAMPLES

Example 1

As an Example, the method of the present invention may be performed as follows:

The surface finish was applied to the sailcloth in one of the last steps of the manufacturing process of the sailcloth, when the sailcloth was ready for confection. The surface was treated with the highly reactive fluorcarbon modified silane, 1h,1h,2h,2h perfluordecyltrichlorosilane with a purity of 97% (Gelest Inc., Morrisville, Pa.). The material was applied in the form of a monolayer, which resulted in only a small increase in weight. The method of gas phase deposition of the fluorinated alkylsilane was essentially performed as follows. An amount of 0.01 liter of the fluorinated alkylsilane was added to the vaporizer. The vaporizer had a volume of 0.1 liter. Nitrogen was used as a carrier gas and was bubbled through the fluorinated alkylsilane liquid to generate a vapor in the headspace of the vaporizer (glass reservoir; volume of liquid of fluorinated alkylsilane 10 milliliter). The fluorinated alkylsilane vapor was fed via glass and silicone tubing to the reactor (2 liter). The reactor consisting of a glass chamber was equipped with an outled to allow air in the reaction chamber to be essentially replaced by vapor, and the chamber was allowed to equilibrate for several minutes. The reactor was equipped with a table to hold the cloth in a vertical position. The cloth 10 cm wide and 20 cm long was essentially completely unfolded and the vapor had free access to the entire surface of the cloth. The entire process was carried out at room temperature and atmospheric pressure. Upon equilibration, the vapor concentration in the reaction chamber was $3\text{-}4*10^{-4}$ kg per $m^3$. The fluorinated alkylsilane was allowed to deposit from the vapor onto the cloth during an overnight period (>14 hours), during which the fluorinated alkylsilane was covalently bonded to the sailcloth. A vapor flow of 3 liter per minute was maintained throughout the procedure. Essentially the same procedure was used for the nylon spinnaker.

Example 2

To test whether a pretreatment is needed the sailcloth was untreated or pretreated with a corona plasma torch (corona) or with a sodium hydroxide solution (etching) prior to application of the hydrophobic finish as described in Example 1. Before each (pre)treatment the sailcloth was washed in ethanol (>99%) to clean the cloth and remove possible spin coating residue for one hour. The corona treatment consisted of passing a plasma torch (Tigres Corona table power input 20 Joule per $cm^2$) over the fabric according to manufacturers instructions. The sodium hydroxide treatment consisted of washing the sailcloth (submerged liquid:fabric ratio=30:1 in Linitester rotary cups with 150 ml liquid in each cup) for one hour in 0.5 M sodium hydroxide solution at 90° C. and a subsequent washing with acetic acid (1 gram per liter) and de-mineralized water (see above) to neutralize the cloth.

Following these pretreatments the sailcloths were dried and subjected to the hydrophobization process desacribed above.

To test the durability of the fluorinated alkylsilane layer the sailclotch was washed after hydrophobization with de-mineralized water, salt water (37% NaCl), toluene and soap for one hour. Also a duration test with de-mineralized water for 3.5 days was preformed as well as a wear resistance test with rotating balls (stainless steel, 6 mm diameter; 10 steel balls were added to each cup, see above) in de-mineralized water for one hour. For all the washing during this process a rotating cup (a cup with 150 ml liquid and fabric is closed and put on a rotating panel which rotates about 20 times a minute) was used filled with the sailcloth and the liquid used.

Optimization tests were preformed to optimize the reaction time and to investigate the influence of the reaction time. Also the use of a commercial available solution, ECC 3000 (3M, St. Paul, Minn.) and the application of methyltrimethoxysilane by spraying was tested. Wetting the sailcloth just before the reaction with the gas phase fluorinated alkylsilane could increase the polymerization of the fluorinated alkylsilane on the surface of the cloth. Also the influence of heating the treated sailcloth after treatment was investigated.

Results

The contact angle was measured using a Kriiss DSA100, drop shape analyzer.

Using 1h,1h,2h,2h perfluordecyltrichlorosilane in the gas phase very good hydrophobic properties were achieved. The samples pre-treated with the corona and the sodium hydroxide treatments as well as the untreated sample are measured before the fluorinated alkylsilane treatment. A static contact angle could not be measured due to the adsorption of the water droplet. The static contact angle of the samples after overnight exposure to the fluorinated alkylsilane gas phase were determined and are displayed in tables 1 to 3 for the different cloths. Taking the deviation of these measurements in account, which are approximately 0.5 to 1 degrees, no significant differences between the blanco and the pre-treated samples were noticed. Only in the case of nylon has the etched cloth a significant higher contact angle after hydrophobization than the other samples. Overall, the contact angle of the nylon cloth is slightly lower than contact angle of the polyester cloth.

TABLE 1

Static contact angle of the polyester sailcloth pretreated with corona plasma treatment and etched with sodium hydroxide

| PET Sailcloth | Contact angle (°) |
|---|---|
| Blanco | 138.5 |
| Corona | 139.0 |
| Etched | 138.0 |

TABLE 2

Static contact angle of the impregnated polyester sailcloth pretreated with corona plasma treatment and etched with sodium hydroxide

| PET Impregnated with resin Sailcloth | Contact angle (°) |
|---|---|
| Blanco | 136.9 |
| Corona | 133.8 |
| Etched | 141.0 |

(Impregnated indicates that the basic fabric is impregnated with a melamine-formaldehyde resin (MFR) finish (CAS No. 9003-08-1, such as available from INEOS Melamines GmbH, Frankfurt am Main, Germany).

This a standard procedure when producing sail cloths, see e.g. WO2005/061778)

TABLE 3

Static contact angle of the nylon spinnaker pretreated with corona plasma treatment and etched with sodium hydroxide

| Nylon Spinnaker | Contact angle (°) |
|---|---|
| Blanco | 124.2 |
| Corona | 124.3 |
| Etched | 132.8 |

Example 3

To measure the durability of the fluorinated alkylsilane coating the sailcloths as prepared above in Example 2 were washed for one hour in de-mineralized water, salt water, toluene and soap. The contact angle was measured before and after the washing process. The reduction of the contact angle was calculated. It is noticed before that the pretreatment had no significant effect on the contact angle. The influence of the pretreatment is still taken into account by the durability tests. As mentioned before the standard deviation is approximately about 0.5 to 1 degrees.

TABLE 4 static contact angle of the polyester sailcloth washed with demineralized water, salt water, toluene and soap for one hour

| PET Sailcloth | Contact angle (°) | Wash Liquid | Contact angle (°) | Reduction % |
|---|---|---|---|---|
| Blanco | 138.5 | Water | 129.7 | 6.4% |
| Corona | 139.0 | Water | 130.3 | 6.2% |
| Etched | 138.0 | Water | 131.8 | 4.5% |
| Blanco 1 | 136.7 | Not washed | 138.8 | −1.5% |
| Blanco 2 | 139.1 | Salt water | 138.6 | 0.4% |
| Blanco 3 | 138.6 | Toluene | 134.2 | 3.1% |
| Blanco 4 | 139.7 | Soap | 133.9 | 4.1% |

A reduction in the contact angle of more than 6 percent was observed for the non-pretreated (blanco) and the corona pretreated polyester sailcloth washed with water. This reduction in the contact angle, caused by washing these cloths with water, is statistically significant (above 3 times the standard deviation) and therefore a small reduction in hydrophobicity was observed. The reduction in the contact angle of the sailcloth pre-treated with sodium hydroxide was not statistically significant. The same holds for the blanco washed with salt water, toluene and soap. Even the reference sample (blanco 1), which was not washed at all, shows a slight deviation, although here the contact angle increased.

To measure the reduction of the static contact angle when exposed to de-mineralized water for a longer period, polyester sailcloth was submerged in de-mineralized water for 3.5 days. After 3.5 days the static contact angle was measured and the reduction was calculated. The reduction was about 8 percent which indicates that the static contact angle decreases slightly during long-term contact with water.

TABLE 5 static contact angle of the polyester sailcloth submerged in demineralized water for 3.5 day's

| PET Sailcloth | Contact angle (°) | Wash Liquid | Contact angle (°) | Reduction % |
|---|---|---|---|---|
| Blanco | 138.8 | Water | 127.6 | 8.1% |
| Blanco | 136.4 | Water | 125.7 | 7.8% |

TABLE 6 static contact angle of the impregnated polyester sailcloth washed with de-mineralized water, salt water, toluene and soap for one hour.

| PET Impregnated Sailcloth | Contact angle (°) | Wash Liquid | Contact angle (°) | Reduction % |
|---|---|---|---|---|
| Blanco 1 | 133.9 | Water | 140.4 | −4.9% |
| Corona 1 | 138.2 | Water | 137.6 | 0.4% |
| Etched 1 | 145.1 | Water | 141.8 | 2.2% |
| Blanco 2 | 137.3 | Salt water | 135.6 | 1.2% |
| Corona 2 | 131.9 | Salt water | 132.2 | −0.2% |
| Etched 2 | 142.1 | Salt water | 136.5 | 3.9% |
| Blanco 3 | 135.4 | Toluene | 141.4 | −4.4% |
| Corona 3 | 128.9 | Toluene | 129.7 | −0.6% |
| Etched 3 | 138.7 | Toluene | 135.4 | 2.4% |
| Blanco 4 | 140.9 | Soap | 140.9 | 0.0% |
| Corona 4 | 133.6 | Soap | 138.1 | −3.4% |
| Etched 4 | 135.7 | Soap | 141.8 | −4.5% |
| Corona 5 | 136.5 | Not washed | 139.4 | −2.2% |
| Etched 5 | 143.4 | Not washed | 147.0 | −2.5% |

The reductions noticed after washing the impregnated polyester sailcloth are all within the deviation. Although it should be noticed that for the blanco samples the other side of the samples are measured after the washing process because the fit was better on this side. The better fit results in a higher contact angle and therefore a negative reduction. Still the results does not imply that washing the impregnated polyester sailcloth for one hour in de-mineralized water, salt water, toluene and soap does affect the contact angle significant. Also the differences between the corona and etched pre-treated sailcloth are within the deviation and therefore not significant.

The measurements of the contact angles on the nylon cloth are not quit accurate because the surface is slightly wrinkled. The contact angles of the nylon cloth are lower than the contact angles of the polyester cloth. After washing the nylon cloth with water an increase in contact angle is measured from 5 up to 17%. This is probably due to difficulties measuring the contact angle.

TABLE 7 static contact angle of the nylon spinnaker washed with de-mineralized water for one hour

| Nylon Spinnaker | Contact angle (°) | Wash Liquid | Contact angle (°) | Reduction % |
|---|---|---|---|---|
| Blanco | 124.2 | Water | 134.2 | −8.0% |
| Corona | 124.3 | Water | 145.5 | −17.1% |
| Etched | 132.8 | Water | 139.5 | −5.0% |

The sailcloth's are treated overnight but the time necessary to get good hydrophobic properties might be lower. To optimize the processing time and investigate what influences a lower processing time has a series of samples are treated in time. It turns out that with the current setup the optimal processing time is two hours. Increasing the processing time does not affect the contact angle while a lower processing time decreases the contact angle.

The added weight during treatment overnight is approximately 4.50 to 6.25 g/m2 while treating the samples for two hours added 1.00 to 1.25 g/m2. These numbers indicates that during treatment overnight possible polymerization occurs. A thicker layer of fluorinated alkylsilanes does not affect the contact angle because the active surface causing the hydrophobic properties does not change. The influence of a smaller layer of fluorinated alkylsilanes on the durability is investigated by washing polyester sailcloth that is treated for two hours (table 8).

To increase the possible polymerization grade a blanco sample is wetted just before treatment with the gas phase fluorinated alkylsilane for two hours. Also the influence of heating the sample after treatment at 100° C. for 10 minutes was investigated. The contact angles are displayed in table 8. No significant increase in contact angle is noticed for the wetted samples and even a decrease in contact angle for the heated samples is noticed.

TABLE 8 static contact angle of impregnated polyester sailcloth treated for two hours with fluorinated alkylsilane, wetted before treatment, heated after treatment and washed with de-mineralized water, salt water, toluene and soap for one hour.

| PET Impregnated Sailcloth | Contact angle (°) | Wash Liquid | Contact angle (°) | Reduction % |
|---|---|---|---|---|
| Blanco 1 wetted | 137.9 | | | |
| Blanco 2 wetted | 136.8 | | | |
| Blanco 3 heated | 126.8 | | | |

TABLE 8-continued static contact angle of impregnated polyester sailcloth treated for two hours with fluorinated alkylsilane, wetted before treatment, heated after treatment and washed with de-mineralized water, salt water, toluene and soap for one hour.

| PET Impregnated Sailcloth | Contact angle (°) | Wash Liquid | Contact angle (°) | Reduction % |
|---|---|---|---|---|
| Blanco 4 heated | 127.3 | | | |
| Blanco 5 | 141.8 | Water | 134.0 | 5.5% |
| Blanco 6 | 136.3 | Salt water | 132.6 | 2.7% |
| Blanco 7 | 137.7 | Toluene | 134.1 | 2.6% |
| Blanco 8 | 136.0 | Soap | 135.0 | 0.7% |

The samples 5 to 8 are treated with the gas phase fluorinated alkylsilane for two hours and are washed afterwards with de-mineralized water, salt water, toluene and soap. The highest reduction in contact angle is noticed when washing with de-mineralized water and the lowest reduction when washing with soap. The results do not differ much from the results obtained with the treatment overnight. A lower treatment time does not affect the durability of the static contact angle significant.

To test the durability and wear resistance of the impregnated sailcloth, the treated sailcloth is washed with balls added to the washing liquid. The samples TL08.07 and TL08.08 are treated with gas phase fluorinated alkylsilane overnight and for three hours respectively. The samples are washed with de-mineralized water with 50 RVS balls with a diameter of 6 mm added. The samples blanco 1 are washed for one hour while the samples blanco 2 are washed for eight hours.

TABLE 9 static contact angle of impregnated polyester sailcloth treated overnight and for 3 hours with fluorinated alkylsilane, washed with de-mineralized water with balls added for 2 and 8 hours.

| PET Impregnated Sailcloth | Contact angle (°) | Wash Liquid | Contact angle (°) | Reduction % |
|---|---|---|---|---|
| TL08.07 Blanco 1 | 136.6 | Balls 1 h | 137.6 | −0.7% |
| TL08.07 Blanco 2 | 138.4 | Balls 8 h | 134.5 | 2.8% |
| TL08.08 Blanco 1 | 132.8 | Balls 1 h | 136.7 | −3.0% |
| TL08.08 Blanco 2 | 137.2 | Balls 8 h | 135.7 | 1.1% |

The samples that were washed for one hour show an increase in static contact angle while the samples washed for eight hours show a decrease. Still the reduction is within the standard deviation and therefore not significant. Also a significant difference between the samples treated with fluorinated alkylsilane for three hours the samples treated overnight can not be noticed. The samples did prove to be wear resistant although it should be mentioned that the static contact angles measured the second and third time are not as consistent as they were before washing with the balls.

Instead of the static contact angle also an advancing and receding angle is measured in some cases. The advancing angle is a measurement of the contact angle on an increasing droplet and the receding angle a measurement on a decreasing droplet. The advancing angle is in most cases the same or slightly higher than the static contact angle.

Some alternative application methods and chemicals are tested as well to investigate there usability and performance. The commercial product ECC 3000, supplied by 3M, and the methyltrimethoxysilane applied by airbrush did not have sufficient increased the hydrophobic properties that a contact angle could be measured. Therefore no further research is preformed with these products.

CONCLUSIONS

Very good hydrophobic properties were achieved when using 1 h,1h,2h,2h perfluordecyltrichlorosilane in a gas phase treatment process.

Pre-treatment of the sailcloth does not significantly increase the hydrophobic properties or the durability of the coating obtained.

The contact angle decreases not or only slightly when the sailcloth is exposed to water for a longer period.

The invention claimed is:

1. A method for hydrophobization of a fabric surface in a single step, the method comprising providing a stream of a substantially anhydrous alkylsilane vapor by either:

a) passing a stream of a substantially anhydrous gas over or through a substantially anhydrous liquid of a fluorinated alkylsilane, or b) spraying a substantially anhydrous liquid of a fluorinated alkylsilane into a stream of a substantially anhydrous gas, and bringing said vapor stream in contact with the fabric surface, thereby allowing the alkylsilane to covalently bind directly to the fabric surface and forming a layer with a thickness of less than 500 Angstrom, wherein said fluorinated alkylsilane is a perfluoroalkylsilane with the general formula:

$$CF_3—(CF_2)_n—(CH_2)_m—SiX_3$$

wherein, n is an integer from 0 to 12 m is an integer from 2 to 5

X is a hydrolyzable group, and wherein the hydrophobized fabric surface has a water contact angle of greater than 100°.

2. Method according to claim 1, wherein said fabric is essentially untreated, said fabric being a sailcloth material.

3. Method according to claim 2, wherein said sailcloth material is based on UHMWPE, LCP, PEN, PET, carbon, glass fiber, polyamid or aramid or combinations thereof.

4. Method according to claim 1, wherein said fluorinated alkylsilane is $R_nSiF_{(4-n)}$, wherein n is an integer between 1 and 3 and R is an alkyl moiety.

5. Method according to claim 1, wherein the hydrolyzable groups are independently selected from the group consisting of (a) organic groups linked to the silicon atom by an oxygen bond, and (b) halogens.

6. Method according to claim 1, wherein said perfluoroalkylsilane is selected from the group consisting of 1H, 1H, 2H, 2H-perfluorooctyltrichlorosilane, 1H, 1H, 2H, 2H-perfluorodecyltrichlorosilane, and 1H, 1H, 2H, 2H-perfluorododecyltrichlorosilane.

7. Method according to claim 1, wherein said substantially anhydrous gas is nitrogen, argon or dry air.

8. Fabric comprising a superhydrophobic surface finish prepared by a method according to claim 1.

9. Fabric according to claim 8, wherein said alkylsilane is bonded directly to the fabric surface by chemisorption without an intermediate layer.

10. Fabric according to claim 8, wherein said fabric is a porous fabric having a porosity of at least 50%.

11. Fabric according to claim 8, wherein said fabric is a sailcloth material.

12. Fabric according to claim 11, wherein said sailcloth material is based on ultra high molecular weight polyethylene, liquid crystal polymer, polyethylene naphthalate, polyethylene terephthalate, carbon, glass fiber, polyamid or aramid or combinations thereof.

13. A device for hydrophobization of a fabric surface according to the method of claim 1, the device comprising a reservoir for holding a substantially anhydrous liquid of perfluoroalkylsilane, said reservoir comprising an inlet for receiving a flow of a substantially anhydrous gas, wherein said reservoir is adapted to allow passage of said substantially anhydrous gas over or through said substantially anhydrous liquid to provide a vapor of said perfluoroalkylsilane; said reservoir further comprising a conduit for passing said perfluoroalkylsilane vapor to a coating chamber; and wherein said coating chamber is configured to hold a fabric and expose the surface of said fabric to the perfluoroalkylsilane vapor.

14. A device for hydrophobization of a fabric surface according to claim 13, wherein said reservoir is configured for nebulating said perfluoroalkylsilane and having an outlet arranged for the formation of a spray of the perfluoroalkylsilane there from, wherein said outlet is engaged with a conduit that is configured to transport a flow of a substantially anhydrous gas from a suitable gas source to the coating chamber, wherein said engagement allows for the mixing of the spray of the perfluoroalkylsilane leaving the outlet with said carrier gas in said conduit at a position between said gas source and said coating chamber to provide a perfluoroalkylsilane vapor.

15. A device according to claim 13, wherein said fabric is a sailcloth material.

16. A device according to claim 15, wherein said sailcloth material is based UHMWPE, LCP, PEN, PET, carbon, glass fiber, polyamid or aramid or combinations thereof.

* * * * *